US007157704B2

(12) United States Patent
Krichtafovitch et al.

(10) Patent No.: US 7,157,704 B2
(45) Date of Patent: Jan. 2, 2007

(54) CORONA DISCHARGE ELECTRODE AND METHOD OF OPERATING THE SAME

(75) Inventors: Igor A. Krichtafovitch, Kirkland, WA (US); Jacob Oharah, Bothell, WA (US); John Thompson, Mukilteo, WA (US)

(73) Assignee: Kronos Advanced Technologies, Inc., Belmont, MA (US)

( * ) Notice: Subject to any disclaimer, the term of this patent is extended or adjusted under 35 U.S.C. 154(b) by 0 days.

(21) Appl. No.: 10/724,707

(22) Filed: Dec. 2, 2003

(65) Prior Publication Data

US 2005/0116166 A1 Jun. 2, 2005

(51) Int. Cl.
*H01T 19/04* (2006.01)

(52) U.S. Cl. ..... 250/324; 250/326; 250/426

(58) Field of Classification Search ..... 250/324, 250/326, 426

See application file for complete search history.

(56) References Cited

U.S. PATENT DOCUMENTS

| | | | |
|---|---|---|---|
| 1,888,606 | A | 11/1932 | Nesbit |
| 1,934,923 | A | 11/1933 | Heinrich |
| 1,959,374 | A | 5/1934 | Lissman |
| 2,590,447 | A | 3/1952 | Nord, Jr. et al. |
| 2,765,975 | A | 10/1956 | Lindenblad |
| 2,949,550 | A | 8/1960 | Brown |
| 2,950,387 | A | 8/1960 | Brubaker |
| 3,026,964 | A | 3/1962 | Penney |
| 3,071,705 | A | 1/1963 | Coleman et al. |
| 3,108,394 | A | 10/1963 | Ellman et al. |
| 3,198,726 | A | 8/1965 | Trikilis |
| 3,267,860 | A | 8/1966 | Brown |
| 3,374,941 | A | 3/1968 | Okress |
| 3,443,358 | A | 5/1969 | Drenning et al. |
| 3,518,462 | A | 6/1970 | Brown |
| 3,582,694 | A | 6/1971 | Gourdine |
| 3,638,058 | A | 1/1972 | Fritzius |
| 3,675,096 | A | 7/1972 | Kiess |
| 3,699,387 | A | 10/1972 | Edwards |
| 3,740,927 | A | 6/1973 | Vincent |
| 3,751,715 | A | 8/1973 | Edwards |
| 3,892,927 | A | 7/1975 | Lindenberg |
| 3,896,347 | A | 7/1975 | Gelfand |
| 3,907,520 | A | 9/1975 | Huang et al. |
| 3,918,939 | A | 11/1975 | Hardt |
| 3,936,635 | A | 2/1976 | Clark |
| 3,981,695 | A | 9/1976 | Fuchs |
| 3,983,393 | A | 9/1976 | Thettu et al. |
| 3,984,215 | A | 10/1976 | Zucker |

(Continued)

FOREIGN PATENT DOCUMENTS

| | | | |
|---|---|---|---|
| JP | 60114363 | * | 6/1985 |

(Continued)

OTHER PUBLICATIONS

Manual on Current Mode PWM Controller, LinFinity Microelectronics (SG1842/SG1843 Series, Apr. 2000).

(Continued)

*Primary Examiner*—Nikita Wells
*Assistant Examiner*—Anthony Quash
(74) *Attorney, Agent, or Firm*—Fulbright & Jaworski L.L.P.

(57) ABSTRACT

A method of operating a corona discharge device includes producing a high-intensity electric field in an immediate vicinity of at least one corona electrode and continuously or periodically heating the corona electrode to a temperature sufficient to mitigate an undesirable effect of an impurity, such as an oxide layer, formed on the corona electrode.

35 Claims, 6 Drawing Sheets

U.S. PATENT DOCUMENTS

| | | | | |
|---|---|---|---|---|
| 4,008,057 | A | | 2/1977 | Gelfand et al. |
| 4,011,719 | A | | 3/1977 | Banks |
| 4,061,961 | A | | 12/1977 | Baker |
| 4,086,152 | A | | 4/1978 | Rich et al. |
| 4,086,650 | A | | 4/1978 | Davis et al. |
| 4,124,003 | A | | 11/1978 | Abe et al. |
| 4,126,434 | A | | 11/1978 | Keiichi |
| 4,156,885 | A | | 5/1979 | Baker et al. |
| 4,162,144 | A | | 7/1979 | Cheney |
| 4,210,847 | A | | 7/1980 | Shannon et al. |
| 4,216,000 | A | | 8/1980 | Kofoid |
| 4,231,766 | A | | 11/1980 | Spurgin |
| 4,232,355 | A | | 11/1980 | Finger et al. |
| 4,240,809 | A | | 12/1980 | Elsbernd et al. |
| RE30,480 | E | | 1/1981 | Gelfand |
| 4,246,010 | A | | 1/1981 | Honacker |
| 4,259,707 | A | | 3/1981 | Penney |
| 4,266,948 | A | | 5/1981 | Teague et al. |
| 4,267,502 | A | | 5/1981 | Reese et al. |
| 4,292,493 | A | | 9/1981 | Selander et al. |
| 4,313,741 | A | | 2/1982 | Masuda et al. |
| 4,315,837 | A | | 2/1982 | Rourke et al. |
| 4,335,414 | A | | 6/1982 | Weber |
| 4,351,648 | A | | 9/1982 | Penney |
| 4,369,776 | A | | 1/1983 | Roberts |
| 4,376,637 | A | | 3/1983 | Yang |
| 4,379,129 | A | | 4/1983 | Abe |
| 4,380,720 | A | | 4/1983 | Fleck |
| 4,388,274 | A | | 6/1983 | Rourke et al. |
| 4,390,831 | A | | 6/1983 | Byrd et al. |
| 4,401,385 | A | | 8/1983 | Katayama et al. |
| 4,477,268 | A | | 10/1984 | Kalt |
| 4,481,017 | A | | 11/1984 | Furlong |
| 4,496,375 | A | | 1/1985 | Le Vantine |
| 4,567,541 | A | | 1/1986 | Terai |
| 4,574,326 | A | * | 3/1986 | Myochin et al. ..... 361/229 |
| 4,600,411 | A | | 7/1986 | Santamaria |
| 4,604,112 | A | | 8/1986 | Ciliberti et al. |
| 4,632,135 | A | | 12/1986 | Lenting et al. |
| 4,643,745 | A | | 2/1987 | Sakakibara et al. |
| 4,646,196 | A | | 2/1987 | Reale |
| 4,649,703 | A | | 3/1987 | Dettling et al. |
| 4,673,416 | A | | 6/1987 | Sakakibara et al. |
| 4,689,056 | A | * | 8/1987 | Noguchi et al. ..... 96/79 |
| 4,713,724 | A | | 12/1987 | Voelkel |
| 4,719,535 | A | | 1/1988 | Zhenjun et al. |
| 4,740,826 | A | | 4/1988 | Halleck |
| 4,741,746 | A | | 5/1988 | Chao et al. |
| 4,772,998 | A | | 9/1988 | Guenther, Jr. et al. |
| 4,775,915 | A | | 10/1988 | Walgrove, III |
| 4,783,595 | A | | 11/1988 | Seidl |
| 4,789,801 | A | | 12/1988 | Lee |
| 4,790,861 | A | | 12/1988 | Watai et al. |
| 4,808,200 | A | | 2/1989 | Dallhammer et al. |
| 4,811,159 | A | | 3/1989 | Foster, Jr. |
| 4,812,711 | A | | 3/1989 | Torok et al. |
| 4,837,658 | A | | 6/1989 | Reale |
| 4,838,021 | A | | 6/1989 | Beattie |
| 4,853,719 | A | | 8/1989 | Reale |
| 4,853,735 | A | | 8/1989 | Kodama et al. |
| 4,878,149 | A | | 10/1989 | Stiehl et al. |
| 4,924,937 | A | | 5/1990 | Beal et al. |
| 4,936,876 | A | | 6/1990 | Reyes |
| 4,938,786 | A | | 7/1990 | Tonomoto |
| 4,941,068 | A | | 7/1990 | Hofmann |
| 4,941,353 | A | | 7/1990 | Fukatsu et al. |
| 4,980,611 | A | | 12/1990 | Orenstein |
| 4,996,473 | A | | 2/1991 | Markson et al. |
| 5,012,159 | A | | 4/1991 | Torok et al. |
| 5,024,685 | A | | 6/1991 | Torok et al. |
| 5,055,118 | A | | 10/1991 | Nagoshi et al. |
| 5,059,219 | A | | 10/1991 | Plaks et al. |
| 5,072,746 | A | | 12/1991 | Kantor |
| 5,077,500 | A | | 12/1991 | Torok et al. |
| 5,087,943 | A | | 2/1992 | Creveling |
| 5,136,461 | A | | 8/1992 | Zellweger |
| 5,138,348 | A | * | 8/1992 | Hosaka et al. ..... 347/128 |
| 5,138,513 | A | | 8/1992 | Weinstein |
| 5,155,531 | A | | 10/1992 | Kurotori et al. |
| 5,163,983 | A | | 11/1992 | Lee |
| 5,199,257 | A | | 4/1993 | Colletta et al. |
| 5,215,558 | A | | 6/1993 | Moon |
| 5,245,692 | A | | 9/1993 | Kawai |
| 5,257,073 | A | | 10/1993 | Gross et al. |
| 5,269,131 | A | | 12/1993 | Brophy |
| 5,330,559 | A | | 7/1994 | Cheney et al. |
| 5,368,839 | A | | 11/1994 | Aime et al. |
| 5,369,953 | A | | 12/1994 | Brophy |
| 5,423,902 | A | | 6/1995 | Strutz et al. |
| 5,469,242 | A | * | 11/1995 | Yu et al. ..... 399/172 |
| 5,474,599 | A | | 12/1995 | Cheney et al. |
| 5,484,472 | A | | 1/1996 | Weinberg |
| 5,508,880 | A | | 4/1996 | Beyer |
| 5,535,089 | A | | 7/1996 | Ford et al. |
| 5,542,967 | A | | 8/1996 | Ponizovsky et al. |
| 5,556,448 | A | | 9/1996 | Cheney et al. |
| 5,569,368 | A | | 10/1996 | Larsky et al. |
| 5,578,112 | A | | 11/1996 | Krause |
| 5,601,636 | A | | 2/1997 | Glucksman |
| 5,642,254 | A | | 6/1997 | Benwood et al. |
| 5,656,063 | A | | 8/1997 | Hsu |
| 5,661,299 | A | | 8/1997 | Purser |
| 5,667,564 | A | | 9/1997 | Weinberg |
| 5,707,422 | A | | 1/1998 | Jacobsson et al. |
| 5,707,428 | A | | 1/1998 | Fedlman et al. |
| 5,769,155 | A | | 6/1998 | Ohadi et al. |
| 5,779,769 | A | | 7/1998 | Jiang |
| 5,814,135 | A | | 9/1998 | Weinberg |
| 5,827,407 | A | | 10/1998 | Wang et al. |
| 5,847,917 | A | | 12/1998 | Suzuki |
| 5,854,742 | A | | 12/1998 | Faulk |
| 5,892,363 | A | | 4/1999 | Roman |
| 5,894,001 | A | | 4/1999 | Hitzler et al. |
| 5,899,666 | A | | 5/1999 | Chung et al. |
| D411,001 | S | | 6/1999 | Pinchuk |
| 5,920,474 | A | | 7/1999 | Johnson et al. |
| 5,942,026 | A | | 8/1999 | Erlichman et al. |
| 5,951,957 | A | | 9/1999 | Simpson |
| 5,973,905 | A | | 10/1999 | Shaw |
| 5,982,102 | A | | 11/1999 | Andzej |
| 5,993,521 | A | | 11/1999 | Loreth et al. |
| D420,438 | S | | 2/2000 | Pinchuk |
| 6,023,155 | A | | 2/2000 | Kalinsky et al. |
| 6,039,816 | A | * | 3/2000 | Morita et al. ..... 134/19 |
| 6,042,637 | A | | 3/2000 | Weinberg |
| 6,056,808 | A | | 5/2000 | Krause |
| D427,300 | S | | 6/2000 | Pinchuk |
| 6,084,350 | A | | 7/2000 | Ezaki et al. |
| 6,108,504 | A | | 8/2000 | Dickhoff |
| 6,125,636 | A | | 10/2000 | Taylor et al. |
| D433,494 | S | | 11/2000 | Pinchuk et al. |
| D434,483 | S | | 11/2000 | Pinchuk |
| 6,145,298 | A | | 11/2000 | Burton |
| 6,152,146 | A | | 11/2000 | Taylor et al. |
| 6,163,098 | A | | 12/2000 | Taylor et al. |
| 6,167,196 | A | | 12/2000 | Huggins et al. |
| 6,176,977 | B1 | | 1/2001 | Taylor et al. |
| 6,182,671 | B1 | | 2/2001 | Taylor et al. |
| D438,513 | S | | 3/2001 | Pinchuk |
| 6,195,827 | B1 | | 3/2001 | Dumitriu |
| 6,200,539 | B1 | | 3/2001 | Sherman et al. |
| 6,203,600 | B1 | | 3/2001 | Loreth |
| D440,290 | S | | 4/2001 | Pinchuk |
| 6,210,642 | B1 | | 4/2001 | Lee et al. |

6,224,653 B1 5/2001 Shvedchikov et al.
6,228,330 B1 5/2001 Herrmann et al.
6,245,126 B1 6/2001 Feldman et al.
6,245,132 B1 6/2001 Feldman et al.
6,270,733 B1 * 8/2001 Rodden ..... 422/186.07
6,312,507 B1 11/2001 Taylor et al.
6,313,064 B1 11/2001 Miyafuji et al.
6,350,417 B1 2/2002 Lau et al.
6,394,086 B1 5/2002 Barnes et al.
6,504,308 B1 * 1/2003 Krichtafovitch et al. ..... 315/111.91
6,574,123 B1 6/2003 Wiser et al.
6,603,268 B1 8/2003 Lee
6,664,741 B1 12/2003 Krichtafovitch
6,888,314 B1 5/2005 Krichtafovitch et al.
6,919,698 B1 7/2005 Krichtafovitch
2001/0004046 A1 6/2001 Taylor et al.
2001/0032544 A1 10/2001 Taylor et al.
2001/0048906 A1 12/2001 Lau et al.
2002/0079212 A1 6/2002 Taylor et al.
2002/0098131 A1 7/2002 Taylor et al.
2002/0122751 A1 9/2002 Sinalko et al.
2002/0122752 A1 9/2002 Taylor et al.
2002/0127156 A1 9/2002 Taylor
2002/0141914 A1 10/2002 Lau et al.
2002/0155041 A1 10/2002 McKinney, Jr. et al.
2003/0033176 A1 2/2003 Hancock
2003/0147785 A1 8/2003 Joannou
2003/0165410 A1 9/2003 Taylor
2003/0170150 A1 9/2003 Lau et al.
2003/0206837 A1 11/2003 Taylor et al.
2003/0206839 A1 11/2003 Taylor et al.
2003/0206840 A1 11/2003 Taylor et al.
2003/0209420 A1 11/2003 Taylor et al.
2003/0234618 A1 12/2003 Krichtafovitch
2004/0004440 A1 1/2004 Krichtafovitch et al.
2004/0004797 A1 1/2004 Krichtafovitch et al.
2004/0025497 A1 2/2004 Truce
2004/0033340 A1 2/2004 Lau et al.
2004/0047775 A1 3/2004 Lau et al.
2004/0052700 A1 3/2004 Kotlyar et al.
2004/0057882 A1 3/2004 Lau et al.
2004/0079233 A1 4/2004 Lau et al.
2004/0211675 A1 * 10/2004 Dong et al. ..... 205/640
2004/0212329 A1 10/2004 Krichtafovitch et al.
2004/0217720 A1 11/2004 krichtafovitch
2005/0151490 A1 7/2005 Krichtafovitch

FOREIGN PATENT DOCUMENTS

JP 63-143954 6/1988

OTHER PUBLICATIONS

Product Catalog of GE-Ding Information Inc. (From Website—www.reedsensor.com.tw).
Request for Ex Parte Reexamination under 37 C.F.R. 1.510; U.S. Appl. No. 90/007,276, filed on Oct. 29, 2004.
Humpries, Stanley, "Principles of Charged Particle Acceleration", Chapter 9, Department of Electrical and Engineering, University of New Mexico, 1999, Download from: <http://www.fieldp.com/cpa/cpa.html>.
Chen, Junhong, "Direct-Current Corona Enhanced Chemical Reactions", Thesis, University of Minnesota, USA. Aug. 2002, Download from: http://www.menet.umn.edu/~jhchen/Junhong_dissertation_final.pdf.

* cited by examiner

CORONA DISCHARGE ELECTRODE AND METHOD OF OPERATING THE SAME

CROSS-REFERENCE TO RELATED APPLICATIONS

The present application is directed to technology related to that described by the Applicant(s) in U.S. patent application Ser. No. 09/419,720 entitled Electrostatic Fluid Accelerator, filed Oct. 14, 1999, now U.S. Pat. No. 6,504,308 issued Jan. 7, 2003; U.S. patent application Ser. No. 10/187,983 entitled Spark Management Method And Device filed Jul. 3, 2002; U.S. patent application Ser. No. 10/175,947 entitled Method Of And Apparatus For Electrostatic Fluid Acceleration Control Of A Fluid Flow filed Jun. 21, 2002; U.S. patent application Ser. No. 10/188,069 entitled An Electrostatic Fluid Accelerator For And A Method Of Controlling Fluid Flow filed Jul. 3, 2002; U.S. patent application Ser. No. 10/352,193 entitled Electrostatic Fluid Accelerator For Controlling Fluid Flow filed Jan. 28, 2003; and U.S. patent application Ser. No. 10/295,869 entitled Electrostatic Fluid Accelerator filed Nov. 18, 2002 which is a continuation of a U.S. provisional application Ser. No. 60/104,573, filed Oct. 16, 1998 all of which are incorporated herein in their entireties by reference.

BACKGROUND OF THE INVENTION

1. Field of the Invention

The invention relates to a device for electrical corona discharge, and particularly to the use of corona discharge technology to generate ions and electrical fields for the movement and control of fluids such as air, other fluids, etc.

2. Description of the Related Art

A number of patents (see, e.g., U.S. Pat. No. 4,210,847 by Shannon, et al. and U.S. Pat. No. 4,231,766 by Spurgin) describe ion generation using an electrode (termed the "corona electrode"), which accelerates ions toward another electrode (termed the "accelerating", "collecting" or "target" electrode, references herein to any to include the others unless otherwise specified or apparent from the context of usage), thereby imparting momentum to the ions in a direction toward the accelerating electrode. Collisions between the ions and an intervening fluid, such as surrounding air molecules, transfer the momentum of the ions to the fluid inducing a corresponding movement of the fluid to achieve an overall movement in a desired fluid flow direction.

U.S. Pat. No. 4,789,801 of Lee, U.S. Pat. No. 5,667,564 of Weinberg, U.S. Pat. No. 6,176,977 of Taylor, et al., and U.S. Pat. No. 4,643,745 of Sakakibara, et al. also describe air movement devices that accelerate air using an electrostatic field. U.S. Pat. No. 6,350,417 and 2001/0048906, Pub. Date Dec. 6, 2001 of Lau, et al. describe a cleaning arrangement that mechanically cleans the corona electrode while removing another set of electrodes from the housing.

While these arrangements provide for some degree of corona electrode cleaning, they do not fully address electrode contamination. Accordingly, a need exists for a system and method that provides for electrode maintenance including cleaning.

SUMMARY OF THE INVENTION

According to an aspect of the invention, a method of operating a corona discharge device includes the steps of producing a high-intensity electric field in an immediate vicinity of a corona electrode and heating at least a portion of the corona electrode to a temperature sufficient to mitigate an undesirable effect of an impurity formed on the corona electrode.

According to another aspect of the invention, a method of operating a corona discharge device includes producing a high-intensity electric field in an immediate vicinity of a plurality of corona electrodes; detecting a condition indicative of initiation of a corona electrode cleaning cycle; interrupting application of a high voltage to at least a portion of the corona electrodes so as to terminate the step of producing the high-intensity electric field with regard to that portion of corona electrodes; applying a heating current to the portion of the corona electrodes sufficient to raise a temperature thereof resulting in at least partial elimination of an impurity formed on the portion of the corona electrodes; and reapplying the high voltage to the portion of the corona electrodes so as to continue producing the high-intensity electric field with regard to that portion of corona electrodes.

According to still another aspect of the invention, a corona discharge device includes a) a high voltage power supply connected to corona electrodes generating a high intensity electric field; b) a low voltage power supply connected to the corona electrodes for resistively heating the corona electrodes and c) control circuitry for selectively connecting the high voltage power supply and low voltage power supply to the corona electrodes.

According to still another aspect of the invention, a method of generating a corona discharge includes generating a high intensity electric field in a vicinity of a corona electrode; converting a portion of an initial corona electrode material of the corona electrode using a chemical reaction that decreases generation of a corona discharge by-product; and heating the corona electrode to a temperature sufficient to substantially restore the converted part of the corona electrode material back to the initial corona electrode material.

DESCRIPTION OF THE PREFERRED EMBODIMENT

Figure 1:
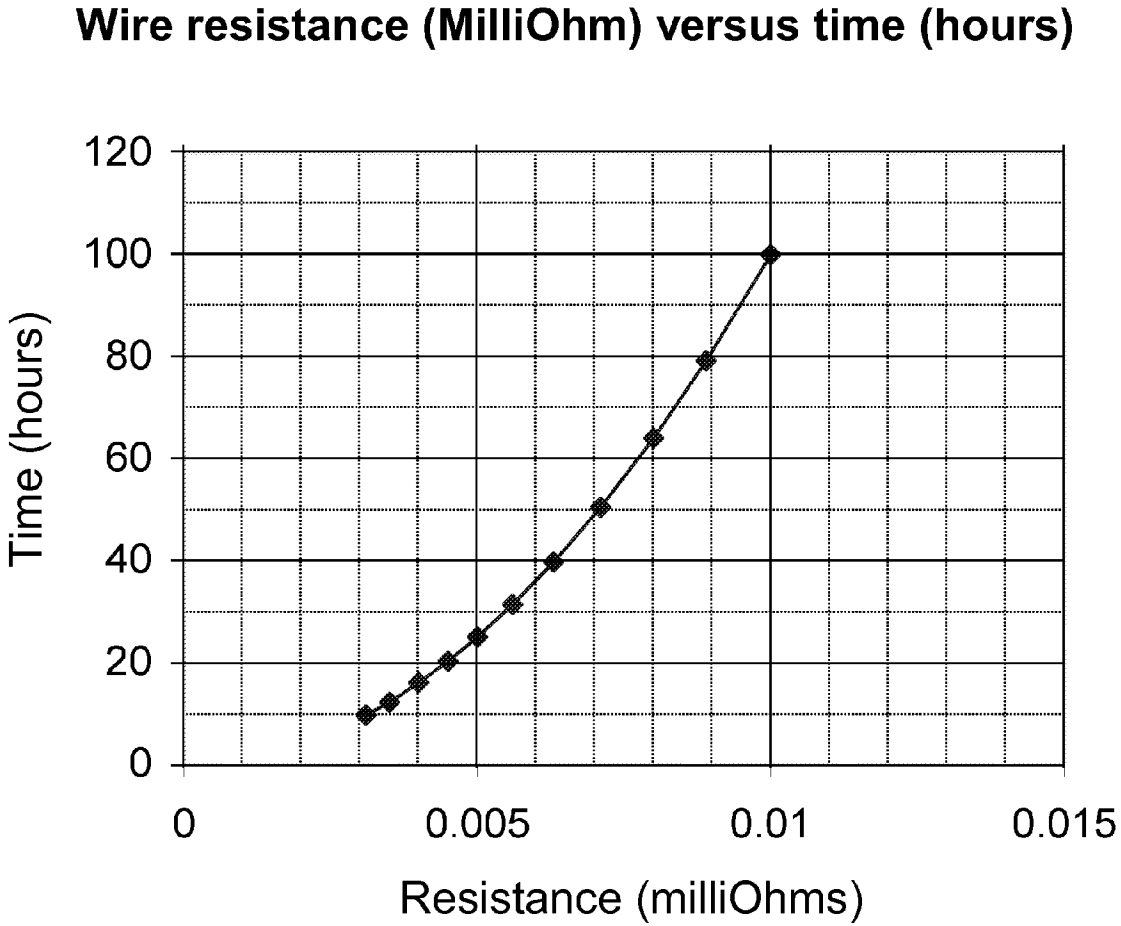
FIG. 1 is a graph showing corona electrode resistance versus electrode operating time.

It has been found that prior electrode cleaning systems and methods do not prevent the degradation of the electrode material. It has also been found that a number of different chemical reactions take place in the corona discharge sheath (e.g., an outer surface layer of the electrode). These chemical reactions lead to rapid oxidation of the corona electrode resulting in increased electrical resistance of three of more times a starting value as shown in FIG. 1. Mere mechanical removal of these oxides has the undesirable effect of also removing some portion of the electrode material, leading to the inevitable degradation of electrode mechanical integrity and performance.

It has also been found that, in addition to pure oxidation of the electrode material, other chemical deposits are formed as a byproduct of the corona discharge process. As evidence from FIG. 1, these contaminants are not conductive and will therefore reduce and eventually block the corona current thus impeding or completely inhibiting corona discharge functioning of an electrostatic device.

Embodiments of the invention address several deficiencies in the prior art including the inability of such prior art devices to keep the corona electrodes clean of chemical deposits, thus extending useful electrode life. For example, chemical deposits formed on the surface of the corona discharge electrodes result in a gradual decrease in corona current. Another cause of electrode contamination results from degradation of the corona discharge electrode material due to the conversion of the initial material (e.g., a metal such as copper, silver, tungsten, etc.) to a metal oxide and other chemical compounds. Another potential problem resulting in decreased performance results from airborne pollutants such as smoke, hair, etc. which may contaminate the corona electrode. These pollutants may lead to cancellation (e.g., a reduction or complete extinguishment) of the corona discharge and/or a reduction of the air gap between the corona and other electrodes.

Still other problems arise when the operation of a corona discharge apparatus produces undesirable or unacceptable levels of ozone as a by-product. Ozone, a gas known to be poisonous, has a maximum acceptable concentration limit of 50 parts per billion. Materials that are commonly used for corona electrodes, such as tungsten, produce substantially higher ozone concentrations and cannot be used in high power applications, i.e. where the corona current is maintained close to a maximum value for a given electrode geometry, configuration and operating condition. In such cases, ozone generation may rapidly exceed the maximum safe and/or allowable level.

Embodiments of the present invention provide an innovative solution to maintaining the corona electrode free of oxides and other deposits and contaminants while keeping the ozone at or below a desirable level.

According to an embodiment of the invention, a corona electrode has a surface made of a material that is preferably easily oxidizable such as silver, lead, zinc, cadmium, etc., and that reduces or minimizes the rate and/or amount of ozone produced by a device. This reduction in ozone generation may result from a relatively low enthalpy of oxide formation of these materials such that these materials can donate oxygen atoms relatively easily. This aids in ozone reduction by depleting the corona area of free oxygen atoms through oxidation ($XO_2+XMe \rightarrow XMeO_x$ where Me stands for metal) and by donating oxygen atoms to ozone through reduction ($O_3+MeO_x \rightarrow 2O_2+MeO_{x-1}$). A high electric field is applied to the vicinity of the corona electrode thus producing the corona discharge. According to one embodiment of the invention, the high electric field is periodically removed or substantially reduced and the corona electrode is heated to a temperature necessary to convert (e.g., "reduce") the corona electrode's material oxide back to the original, substantially un-oxidized metal.

Embodiment of the present invention provides an innovative solution to keep the electrodes free from progressive metal oxide formation by continuous or periodic heating of the electrodes using, for example, an electric heating current flowing through the body of the electrode.

According to an embodiment of the invention, an electric current is continuously or periodically applied to the corona electrodes thus resistively heating and increasing the electrodes temperature to a level sufficient to convert the metal oxides back to the original metal (e.g., removal of oxygen from the oxidized material by "reduction" of the metal-oxide) and simultaneously burn-off contaminants formed or settling on the corona electrode (e.g., dust, pollen, microbes, etc.). A preferred restoration and/or cleaning temperature may be different for different materials. For most of the metal oxides this temperature is sufficiently high to simultaneously burn-off most of the airborne contaminants, such as cigarette smoke, kitchen smoke or organic matter like hairs, pollen, etc., typically in the a range of from 250° C. to 300° C. or greater. However, the temperatures required to restore the electrode and burn-off any contaminants is typically significantly less than a maximum temperature to which the electrode may be heated. For example, pure silver has a melting point of 1234.93K (i.e., 961.78° C. or 1763.2° F.). This sets an absolute maximum temperature limit for this material. In practice, a lower maximum temperature would be dictated by thermal expansion of the electrode causing the wire to sag or otherwise distort and dislocate.

A corona electrode may comprise of, as an example, a silver or silver plated wire having a diameter of, for example, between 0.5–15 mils (i.e., 56 to 27 gauge awg) and preferably about 2 to 6 mils (i.e., 44 to 34 gauge awg) and, even more preferably, 4 mils or 0.1 mm in diameter (38 gauge awg). Given that:

$$R = \frac{\rho l}{A} \text{ where } \rho_{Ag} = 1.6 \times 10^{-8} \Omega \cdot \text{m and}$$

$$A_{9_{awg}} = \pi(1.14 \times 10^{-4}\ \text{m})^2 \quad R = 0.392\ \Omega \cdot \text{m}^{-1}$$

Table 1 gives the resistance in ohms per foot of solid silver wire for a range of wire

TABLE 1

| Gauge | Resistance Ω/ft |
|---|---|
| 20 | 0.009336 |
| 21 | 0.01177 |
| 22 | 0.014935 |
| 23 | 0.018717 |
| 24 | 0.023663 |
| 25 | 0.029837 |
| 26 | 0.037815 |
| 27 | 0.047411 |
| 28 | 0.060217 |
| 29 | 0.074869 |
| 30 | 0.0956 |
| 31 | 0.120692 |
| 32 | 0.149375 |
| 33 | 0.189645 |
| 34 | 0.240867 |
| 35 | 0.304847 |
| 36 | 0.3824 |
| 37 | 0.472099 |
| 38 | 0.5975 |
| 39 | 0.780408 |

sizes expressed in awg gauges. Table 2 gives the estimated current in amperes

TABLE 2

| Wire | Temperature (Degrees F./C.) | | | | | | | | |
|---|---|---|---|---|---|---|---|---|---|
| Diameter (awg) | 400 204 | 600 316 | 800 427 | 1000 538 | 1200 649 | 1400 760 | 1600 871 | 1800 982 | 2000 1093 |
| 28 | 16 | 23 | 29 | 37 | 46 | 56 | 68 | 80 | 92 |
| 29 | 14 | 19 | 25 | 32 | 39 | 48 | 57 | 67 | 78 |
| 30 | 12 | 16 | 21 | 27 | 34 | 41 | 48 | 56 | 65 |
| 31 | 10 | 14 | 18 | 23 | 28 | 34 | 41 | 48 | 55 |
| 32 | 8 | 12 | 15 | 19 | 24 | 29 | 35 | 41 | 46 |
| 33 | 7 | 10 | 13 | 16 | 20 | 25 | 29 | 34 | 39 |
| 34 | 6 | 9 | 11 | 14 | 17 | 21 | 25 | 29 | 34 |
| 35 | 6 | 8 | 10 | 12 | 15 | 18 | 21 | 25 | 28 |
| 36 | 5 | 7 | 8 | 10 | 12 | 15 | 18 | 21 | 24 |
| 37 | 4 | 6 | 7 | 9 | 11 | 13 | 15 | 18 | 21 |
| 38 | 4 | 5 | 6 | 8 | 9 | 11 | 13 | 15 | 18 |
| 39 | 3 | 4 | 5 | 7 | 8 | 9 | 11 | 13 | 15 |
| 40 | 3 | 4 | 5 | 6 | 7 | 8 | 10 | 11 | 13 |
| 41 | 2.6 | 3.3 | 4 | 4.9 | 5.9 | 7 | 8.3 | 9.6 | 11 |
| 42 | 2.2 | 2.9 | 3.4 | 4.2 | 5.1 | 6 | 7.1 | 8.2 | 9.4 |
| 43 | 1.9 | 2.5 | 3 | 3.6 | 4.3 | 5.2 | 6.1 | 7.1 | 8 |
| 44 | 1.7 | 2.1 | 2.6 | 3.2 | 3.8 | 4.5 | 5.3 | 6.1 | 6.9 |
| 45 | 1.4 | 1.8 | 2.3 | 2.7 | 3.3 | 3.9 | 4.6 | 5.3 | 6 |
| 46 | 1.2 | 1.6 | 2 | 2.4 | 2.8 | 3.4 | 3.9 | 4.5 | 5.1 |
| 47 | 1.1 | 1.4 | 1.7 | 2.1 | 2.5 | 3 | 3.4 | 3.9 | 4.4 |
| 48 | 0.9 | 1.2 | 1.5 | 1.8 | 2.1 | 2.5 | 2.9 | 3.3 | 3.7 |
| 49 | 0.8 | 1 | 1.3 | 1.5 | 1.8 | 2.2 | 2.5 | 2.8 | 3.2 |
| 50 | 0.7 | 0.9 | 1.1 | 1.4 | 1.6 | 1.9 | 2.2 | 2.5 | 2.8 |
| 51 | 0.6 | 0.8 | 1 | 1.2 | 1.4 | 1.6 | 1.9 | 2.1 | 2.4 |
| 52 | 0.5 | 0.7 | 0.8 | 1 | 1.2 | 1.4 | 1.6 | 1.8 | 2 |
| 53 | 0.4 | 0.6 | 0.7 | 0.9 | 1 | 1.2 | 1.4 | 1.5 | 1.7 |
| 54 | 0.4 | 0.5 | 0.6 | 0.8 | 0.9 | 1 | 1.2 | 1.3 | 1.5 |
| 55 | 0.4 | 0.5 | 0.6 | 0.7 | 0.8 | 0.9 | 1 | 1.2 | 1.3 |
| 56 | 0.3 | 0.4 | 0.5 | 0.6 | 0.7 | 0.8 | 0.9 | 1 | 1.1 |
| 57 | 0.3 | 0.4 | 0.4 | 0.5 | 0.6 | 0.7 | 0.8 | 0.8 | 0.9 |
| 58 | 0.2 | 0.3 | 0.4 | 0.4 | 0.5 | 0.6 | 0.6 | 0.7 | 0.8 |

required to obtain a specified temperature for a particular gauge of wire (e.g., silver wire realizing that the table includes temperatures exceeding the 1763.2° F./961.78° C. melting point of silver), the values being estimated based on data available for nichrome wires of similar resistance. Although the table includes temperatures well beyond the melting temperature of silver, the maximum temperature needed is based on that necessary to eliminate contaminates including, for example, reduction of any oxide layers. In the case of silver, the oxidation process may be described by the chemical formula:

$$4Ag_{(s)}+O_{2(g)}\rightarrow 2Ag_2O_{(s)}$$

The standard state enthalpy (DHorxn) and entropy (DSorxn) changes for the reaction are −62.2 kJ and −0.133 kJ/K respectively, such that the reaction is exothermic and the entropy of the reaction is negative. In this reaction the entropy and enthalpy terms are in conflict; the enthalpy term favoring the reaction being spontaneous, while the entropy term favoring the reaction being non-spontaneous. Thus, the temperature at which the reaction occurs will determine the spontaneity. The standard Gibb's free energy (DGorxn) of the reaction may be calculated as follows:

$$\Delta G^\circ_{rxn}=\Delta H^\circ_{rxn}-T\Delta S^\circ_{rxn}$$

Substituting for the standard state enthalpy and entropy changes and the standard state temperature of 298° K yields:

$$\Delta G^\circ_{rxn}=-62.2\text{ kJ}-(298\text{ K})(-0.133\text{ kJ/K})$$

$$\Delta G^\circ_{rxn}=-22.6\text{ kJ}$$

Since $\Delta G^\circ_{rxn}<0$, the oxidation reaction is spontaneous at room temperature:

$$T=\Delta H^\circ_{rxn}/\Delta S^\circ_{rxn}$$

$$T=(-62.2\text{ kJ})/(-0.133\text{ kJ/K})$$

$$T=468\text{ K}$$

Thus, for T<468 K the forward oxidation reaction is spontaneous, for T=468 K the reaction is at equilibrium and for T>468 K the reaction would be non-spontaneous or the reverse reaction (i.e., reduction or removal of oxygen), as follows, would be spontaneous:

$$2Ag_2O_{(s)}\rightarrow 4Ag_{(s)}+O_{2(g)}$$

Thus, heating to approximately 200° C. will begin conversion of silver oxide back into silver, while higher temperatures will even further foster the reaction. At the same time, even higher temperatures will eliminate other contaminants, such as dust and pollen, by heating those contaminates to their combustion temperatures (e.g., 250° C. of above for many common pathogens and other contaminants).

As discussed, the corona electrodes are usually made of thin wires and therefore do not require substantial electrical power to heat them to a desired high temperature, e.g., up to 300° C. or greater. On the other hand, high temperature leads to the electrode expansion and wire sagging. Sagging wires may oscillate and either spark or create undesirable noise and sound. To prevent that, the electrode(s) may be stretched, e.g., biased by one or more springs to maintain tension on the wires. Alternatively or in addition, ribs may be employed and arranged to shorten wire parts and prevent oscillation. Still further, a corona generating high voltage may be decreased or removed during at least a portion of the time during which the electrode is heated. In this case, removal of the high voltage prevents wire oscillation and/or sparking.

Removal of the corona generating high voltage results in a corresponding interruption in certain technological processes, i.e., normal device operation such as fluid (e.g., air) acceleration and cleaning. This interruption of operation may be undesirable and/or, in some instances, unacceptable. For instance, it may be unacceptable to interrupt, even for a short period of time, the normal operation of a system used to remove and kill dangerous pathogens or prevent particulates from entering sensitive areas. In such cases, it may be desirable to employ several stages of air purifying equipment (e.g., tandem or series stages) to avoid interruption of critical system operations during cleaning of one of the stages or selectively interrupt the normal operation of subsets of electrodes of a particular stage so that stage operation is degraded but not interrupted. Thus, air to be treated passes through each of several serially-arranged stages of the air purifying device. At any given time a single stage of the device may be rendered inoperative while undergoing automatic maintenance to perform contaminate removal, while the remaining stages continue to operate normally. Alternatively, selective cleaning of some portion of electrodes of a stage while the remaining electrodes of the stage continue to operate normally may provide sufficient air purification that device operation continues in an acceptable, though possibly degraded mode, of operation.

For more advanced air purifying systems, a sophisticated and/or intelligent duct system may be used. In such a system, air may pass through a number of essentially parallel ducts, i.e. through several but not necessarily all ducts, each duct including an electrostatic air purification device. In such a system, it may be desirable to include logic and air handling/routing mechanisms to ensure that the air passes through at least one set of air purifying electrodes in order to provide any required level of air purification. Air routing may be accomplished by electrostatic air handling equipment as described in Applicant's earlier U.S. Patent Applications referenced above.

Electrical heating of the electrodes requires proper control of power applied to each electrode. However, the electrical resistance of each corona electrode may vary from one to another. Since the final temperature of the electrode is a function of the net amount of electrical (or other form) of energy applied and eventually converted to thermal energy (minus thermal energy consumed and lost), electrode temperature is related to the net electrical power dissipated. It is therefore desirable to control the amount of the electrical power applied to the electrode in contrast to regulating voltage and/or current separately. In other words, applying a certain voltage or current to the electrode wire will not necessarily guarantee that the required amount of power will be dissipated in the electrode so as to generate the required amount of thermal energy and temperature increase.

The electrical power P is equal to $$P=V^2/R=I^2\times R.$$

Where P is expressed in Watts or Joules/second.

For a long wire of diameter D and electrical resistance per unit length R initially in thermal equilibrium with the ambient air and its surrounds, the following equations express variation of the wires temperature during passage of the current:

$$\dot{E}_g = \dot{E}_{out} + \dot{E}_S \text{ where}$$

$$\begin{cases} \dot{E}_g = I^2 RL \\ \dot{E}_S = \frac{\partial}{\partial t}(\rho CVT) \equiv \rho CV\frac{dT}{dt} = \rho C\left(\frac{\pi D^2}{4}\right)L\frac{dT}{dt} \\ \dot{E}_{out} = \dot{Q}_{conv} + \dot{Q}_{\text{rad}} = h(\pi DL)(T - T_\infty) + \varepsilon\sigma(\pi DL)(T^4 - T_{surr}^4) \end{cases}$$

where $\dot{E}_g$: Energy generation due to resistive heating of wire $\dot{E}_S$: energy stored by wire;

$\dot{E}_{out}$: Energy transported by the fluid (e.g., air) out of a control volume;

I: current

R: resistance

ρ: density;

C: specific heat;

V: volume of wire

T: temperature of wire surface;

$T_\infty$: temperature of fluid;

$T_{surr}$: temperature of surroundings;

L: length of wire;

$\dot{Q}_{conv}$: heat transfer due to convection;

$\dot{Q}_{rad}$: heat transfer due to radiation;

h: heat transfer coefficient of fluid;

D: diameter of wire;

ϵ: emissivity of wire surface;

σ: Stefan-Boltzmann constant: $5.67\times10^{-8}$ W/m$^2$·K$^4$ we obtain:

$$\frac{dT}{dt} = \frac{I^2R - \pi Dh(T - T_\infty) - \pi D\varepsilon\sigma(T^4 - T_{surr}^4)}{\rho C(\pi D^2/4)}$$

We can also calculate the heat energy required to raise the temperature of a substance ignoring heat loss as follows:

$$P=\Delta t(Cp\times\rho\times V)$$

where P is in Watts, Δt is the change in temperature in Kelvin (or Celsius) degrees; Cp is specific heat in Joules per gram-degree Kelvin, ρ is density in grams per cm$^3$, and V is volume in cm$^3$.

For silver, Cp=0.235 J/gK°; ρ=10.5 g/cm3; V=cross sectional area×L:

For example, a corona electrode made of 28 gauge awg silver wire having a cross-sectional area of $8.1\times10^{-4}$ cm$^2$ would require the following amount of power to raise the temperature of the wire 300° C.:

$$P=300\text{K}°(0.235\text{ J/K}°\times10.5\text{ g/cm}^3\times8.1\times10^{-4}\text{ cm}^2)$$

$$P=6.00\times10^{-2}\text{ W/cm}$$

To calculate the current required to provide this power, we first calculate the resistance of the wire when heated to 300° C.:

$$R = \left[\frac{\rho L}{A}\right][1 + \alpha\Delta t]$$

-continued $$R = \left[\frac{1.64\times10^{-6}\ \Omega-\text{cm}-L}{8.1\times10^{-4}\ \text{cm}^2}\right]\times[1+(0.0061\times300)]$$

$$R = 3.701\times10^{-3}\ \Omega/\text{cm}$$

Solving for current I:

$$I = \sqrt{\frac{P}{R}}$$

$$I = \sqrt{\frac{6.00\times10^{-2}\ \text{W}}{3.701\times10^{-3}\ \Omega}}$$

$$I = 1.27\ \text{A}$$

This number assumes no loss of heat. Taking into consideration heat loss due to conduction with the surrounding fluid and radiant heat loss, the actual current is higher as presented in Table 2.

In actuality, heat transfer or loss is based on multiple factors, including:

1. wire surface area.
2. power dissipated.
3. air flow velocity.
4. wire color.
5. temperature.
6. heat accumulation like in enclosure.
7. some minor factors.

The following three equations take into account only some of these factors.

Heat Transfer by Conduction

A=area of contact surface, $ft^2$
d=depth (thickness), in.
H=heat flow, Btu/hr
k=conduction coeff, Btu-in./hr-$ft^2$–° F.
$(t_H-t_L)$=temperature diff., ° F.

$$H=kA(t_H-t_L)/d$$

Heat Transfer by Convection

A=area of contact surface, $ft^2$
H=heat flow, Btu/hr
h=convection coeff, Btu/hr-$ft^2$–° F.
$(t_H-t_L)$=temperature diff., ° F.

$$H=hA(t_H-t_L)$$

Heat Transfer (or Loss) by Radiation Emission

A=area of contact surface, $ft^2$
H=heat flow, Btu/hr
T=absolute temperature, ° R
e=radiation factor $$H=0.174\ E{-}08\ e\ A\ T^4$$

Because of the number of variables, accurate power calculation is very difficult and complex. In contrast, as power and temperature measurements are relatively easily obtained, an experimental technique based on the specific resistance thermal coefficient is preferably used to calculate wire temperature and determine power requirements, e.g., by measuring necessary power dissipation in Watts per inch of wire length. For example, a preferred embodiment of the invention uses a wire with a diameter of about 4 mils or 0.1 mm (38 AWG) heated with 1.5 W per each inch of length. This embodiment relies on a silver coated wire having a solid or hollow core made of a relatively high resistance material, preferably a metal such as stainless steel, copper, or, more preferably, an alloy such as Inconel® (NiCrFe: Ni 76%; Cr 17%; Fe 7%; ρ=103 μΩ-cm). Other core materials may include nickel, kovar, dumet, copper-nickel alloys, nickel-iron alloys, nickel-chromium alloys, stainless steel, tungsten, beryllium copper, phosphor bronze, brass, molybdenum, manganin. The silver coating may be selected to provide the appropriate overall resistance and may have a thickness of approximately 1 micro-inch (i.e., 0.001 mils or 0.025 μm) to 1000 micro-inches (1 mil or 25 μm). For example, a silver coating of from 5 to 33 microinches (i.e., approximately 0.1 to 0.85 μm) in thickness may be plated onto a 44 gauge wire, while a 25 to 200 micro-inches (i.e., approximately 0.5 to 5 μm) plating may be used for a 27 gauge wire, a more preferred 38 gauge wire having a silver plating thickness within a range of 10–55 micro-inches (i.e., 0.01.0 to 0.055 mils or approximately 0.25 to 1.5 μm). Using 1.5 W of electrical energy per inch, a 20" long wire would require 30 W of electrical energy to obtain a suitable peak temperature while a 40" long wire would consume 60 W, although such values may vary based on the parameters and factors mentioned above. However, in general, the greater the level of power applied per inch of conductor, the more rapid the oxide restoration process proceeds. For example, at a power level of 1 W per inch, oxide restoration takes approximately 40 seconds while at 1.6 W per inch this time is reduced to approximately 3 seconds.

As described, it can be seen that the power dissipated by electrode is dependent on the electrical resistance of the electrode, a value that varies based on numerous factors including electrode-specific geometry, contaminants and/or impurities present, electrode temperature, etc. Since it is important to dissipate a certain amount of power that is sufficiently independent of the electrode's resistance and other characteristics, a preferred embodiment of the invention provides a method of and arrangement for meting-out and applying a predetermined amount of electrical energy. This may be accomplished by accumulating and discharging a predetermined amount of electrical energy $P_1$, with a certain frequency f, into the electrode. The amount of electrical power P dissipated is equal to $P=P_1*f$. Accumulation of an electrical charge may be implemented using, for example, a capacitor, or by accumulating magnetic energy in, for example, an inductor, and discharging this stored quantum of energy into the electrode. By using such a method and arrangement, the frequency of such discharge and the amount of the energy are both readily controlled.

According to a preferred embodiment, a fly-back converter working in discontinuous mode may be used as a suitable, relatively simple device to produce a constant amount of electrical power. See, for example, U.S. Pat. No. 6,373,726 of Russell, U.S. Pat. No. 6,023,155 of Kalinsky et al., and U.S. Pat. No. 5,854,742 of Faulk. A fly-back inductor accumulates a magnetic energy $W_M$ equal to $W_M=L I^2/2$, where I=maximum current value in the inductor winding and L=the inductor's inductance. This energy, released to the load f times per second, is equal to the electrical power $P=W_M*f$ Note that the amount of energy released and applied to the electrode is independent of the resistance of the electrode assuming that the fly-back converter operates in a discontinuous mode. Proper fly-back inductor design allows for operation in this mode for a wide range of the electrode resistances.

Power consumption and dissipation of heat generated by the process are issues that are addressed by embodiments of the present invention. Electrostatic devices employing a large number of corona electrodes would require a large amount of electrical power to be applied for proper electrode heating. In spite of the relatively short heating cycle duration necessary to clean the electrodes of contaminants and convert oxide layers back to their original compositions, this time, typically measured in seconds, is substantial and therefore a large and relatively expensive power supply may be required. Therefore, for large systems it may be preferred to divide the corona electrodes into several sections and heat each section in sequence. This would significantly decrease power consumption and, therefore, the cost of the heating arrangement and minimize peak power consumption. The sections may be separate groupings of electrodes or may include sets of electrodes interspersed among one-another to minimize heat buildup in any one portion of a device and provide for enhanced heat dissipation. Alternatively, grouping of electrodes of a particular section may provide more efficient thermal energy usage by minimizing heat loss and maximizing corona electrode temperature.

Dividing corona electrodes into sections for heating purposes necessitates the provisioning of a switching arrangement connected to the power converter (i.e., power supply used to supply corona electrode resistive heating current) to provide electric power to the corona electrodes in sequence or in combination. For instance, according to a preferred embodiment using a silver coated tungsten core wire of 0.1 mm in diameter applying 1.6 W of electrical energy per inch, then if the system has 30 corona electrodes each 12.5 inches in length such that each electrode requires 20 W for heating, several options exist. One option is to apply power to all 30 corona electrodes simultaneously. The corona electrodes may be connected in parallel or in series thus creating an electrical circuit that provides a flow of electric current through all electrodes simultaneously. In this example, 600 W of heating power would be required for the duration of the heating cycle. Despite the short duration of the heating cycle, such a relatively large amount of power necessitates a correspondingly relatively large and costly power supply.

An option to reduce heating power requirements is to split the system into 30 separate corona electrodes. This arrangement would require separate connections to at least one terminal end of each of the 30 electrodes to provide for selective application of power to each, i.e., one-at-a-time. Such an arrangement requires a switching mechanism and procedure to connect each corona electrode to the heating power supply in turn. Such a mechanism may be of a mechanical or electronic design. For example, the switching mechanism may include 30 separate switches or some kind of switching combination with logical control (i.e., a programmable microcontroller or microprocessor) that directs current flow to one electrode at a time. By applying heating current to the electrodes one at a time, power supply requirements are minimized (at the expense of additional switching and wiring structures), in the present example requiring a maximum or peak power of 20 W. Another advantage of such arrangement is a more uniform distribution of the heating power to each electrode.

It should be recognized that when heating power is applied to multiple (for purposes of the present example, 30) parallel electrodes simultaneously, some of the electrodes will consume more power than others because of differences in their respective electrical resistances. Thus, power distribution is either compromised or additional circuitry is required to regulate the application of power to each electrode. This will not be required if a series arrangement is used. Conversely, separately applying heating power to each corona electrode necessitates, in the current example, multiple (i.e., in the present example up to 30) switches as well as an additional control arrangement to individually connect each electrode. Also, since the corona electrodes are separately (e.g., sequentially) heated, the overall time required to perform the process is, in the present example, 30 times longer than a simultaneous cleaning method wherein all electrodes are heated in parallel.

Another embodiment of the invention includes a heating topology intermediate to the previously described arrangements. That is, in the present example, the corona electrodes may be divided into several groups, for example, five groups of corona electrodes, each group including six corona electrodes. This would require a heating power of 120 W (i.e., one fifth the power compared with 30×20 W=600 W for simultaneous heating of all 30 electrodes) but taking overall five times longer to perform a complete heating cycle than in the case of simultaneous electrode heating. Thus, for any particular configuration of electrodes and operational requirements, an optimum arrangement will depend on multiple factors, such as (i) maximum heating power available;
(ii) tolerance/desirability of shot-term or continuous heating of the fluid;
(iii) configuration and cost of switching and heating power distribution; and
(iv) requirements for continuous of the device during cleaning operations of subsets of electrodes.

It has further been observed that the heating power, time required for the heating, and the period between heating cycles may vary for a particular electrode over an operational lifetime of the electrode so as to efficiently remove contaminants. Both the condition of the surface of the electrode prior and subsequent to completion of a heating cycle change over this period, these changes resulting from various factors that may be difficult to predict or accommodate in advance. Thus, a preferred control method used by an electrode cleaning or heating algorithm may accommodate several factors, employ various calculations, etc., to determine and implement an appropriate electrode heating protocol. The protocol may take into consideration and/or monitor one or more factors and parameters including for example, electrode geometry, fluid flow rate, material resistance, electrode age, duration of prior cycles, time since prior cleaning cycle completed, ambient temperature of the fluid, desired heating temperature regiment including heating and cooling rates, etc.

Thus, according to one embodiment of the invention, control of power and heat cycle initiation may be responsive to some measurable parameter indicative of electrode contamination. This parameter may be an observable condition (e.g., electrode reflectivity of light or some other form of radiation) or an electrical characteristic such as the electrical resistance of a particular corona electrode (e.g., each electrode individually, one or more representative sample or control electrodes, etc.) or of some composite resistance measurement (e.g., the overall electrical resistance of some group of corona electrodes, etc.). For example, it has been observed that the electrical resistance of an electrode provides a good indication of the rate and/or degree of oxidation of an electrode and, therefore, the proper timing for electrode heating. Actual initiation and control of a heating cycle in response to electrode resistance (e.g., electrode resistance increasing by some percentage or by some fixed or variable threshold value above a previously measured starting resistance) may be implemented using a number of methods. One method may require monitoring of electrode resistance during and without interruption of nonial corona generation operations. In this case, a small electrical current may be selectively routed through the electrode and a corresponding voltage drop across the electrode may be measured. The resistance may be calculated as a ratio of voltage drop across the electrode to the current through the electrode. As another option, a predetermined current may be selectively routed through the isolated electrode. The electrode resistance may then be calculated based on a voltage drop across the electrode.

For example, assume that a particular corona electrode exhibits a DC resistance of 10 Ohms at some given temperature (e.g., under normal operating conditions). As an oxide layer forms on the electrode, the resistance of the electrode tends to increase up to, in the present example, 20 Ohms over some period of device operation. According to a continuous monitoring embodiment, a constant current of, for example, 10 mA is routed through the electrode. As the resistance of the electrode increases, a voltage drop across the electrode will also increase, eventually reaching 200 mV with a current of 10 mA and resistance of 20 Ohms. In response to detection of the 200 mV drop by, for example, a comparator or other device, a heating step may be initiated to clean the electrode(s) and restore any oxidized material to an original (or near-original) unoxidized state. This method allows for a simple and yet efficient control procedure to provide an optimal heating arrangement during device operation.

Constant power into a certain load (in the present example, to the corona electrodes) stipulates that the loads' (electrodes') resistance is of a limited value. If the resistance reaches a very high value, then the voltage across this resistance must likewise be very high provide the same level of heating power. This may happen if the switching device that connects the power supply from one group of electrodes to another provides a time lag or gap between these consecutive connections so that an open circuit temporarily exists. The proper connection should provide either zero time gaps or an overlap where two or more groups of electrodes are connected to the heating power supply simultaneously.

It should be noted that if the corona technology is intended to move media (e.g., a fluid such as air) by the means of the corona discharge then the corona electrodes will be located in and are under the influence of the passing media, e.g., air. Therefore, some maximum temperature of the corona electrodes may be reached when air velocity (i.e., more generally, an ionic wind rate) is minimum or even zero. The corona electrodes' heating may be also achieved by varying or controlling the combination of both heating power and airflow velocity (i.e., heating and ionic wind rate). For the present example, we assume a heating power of 20 W per electrode is used to heat the electrode to a temperature (e.g., 250° C.–300° C.) sufficient to reverse oxides assuming still air, i.e., heating power sufficient to accomplish a chemical reduction to unbind and remove oxygen from the electrode and thereby reverse a prior oxidation process such as to remove an oxide layer formed on the electrodes. The increase in temperature brought about by electrode heating (e.g., 250° C.–20° C. ambient=230 C°) decreases to half of a no-ionic wind temperature and/or rate when air velocity is increased to, for example, 3 m/s. Therefore, a temperature of the corona electrodes may be controlled and/or regulated by applying a greater or lesser amount of accelerating high voltage between the corona and collecting electrodes thus controlling induced air velocity or, more generally, ionic wind rate. It should be recognized that any ratio between the accelerating voltage (i.e., between the corona and collecting, the last also termed target electrode or, in other terms, anode and cathode) and heating power, provided by any existing means to the corona electrode, is within a scope of the current invention. The best result is achieved, however, when this ratio varies during device operation.

Figure 2:
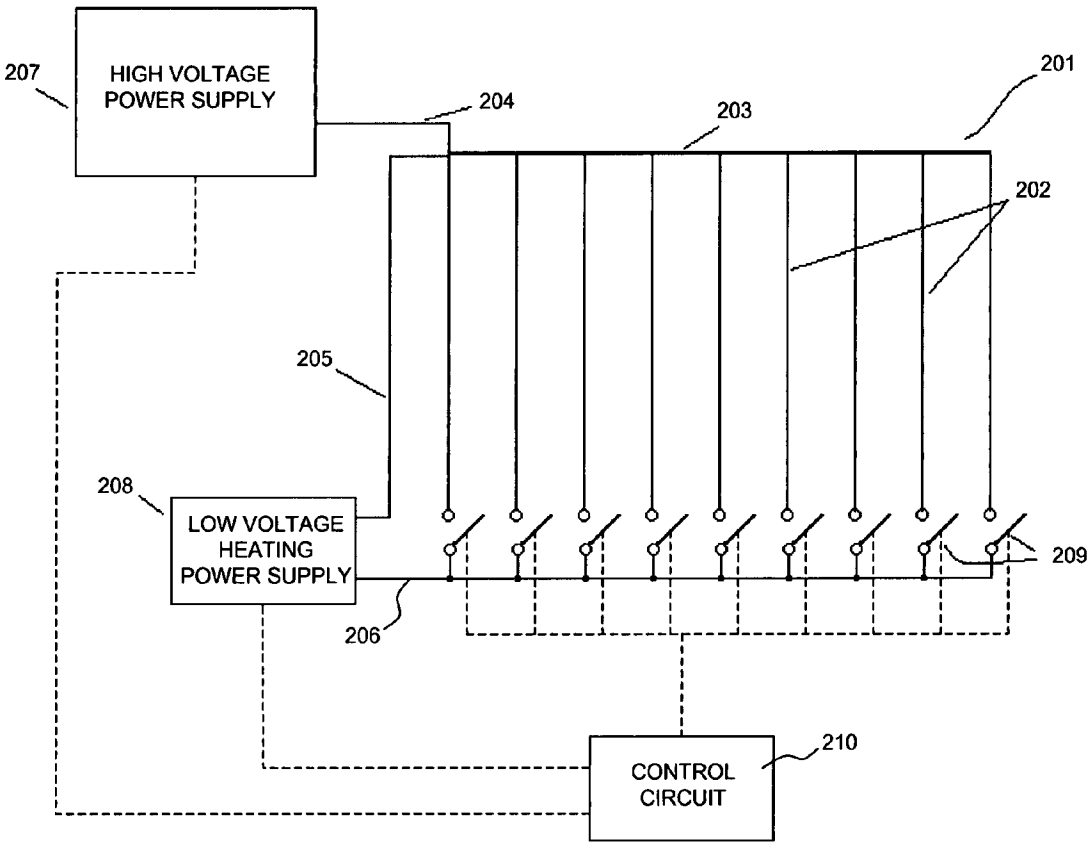
FIG. 2 is a schematic diagram of a system for applying an electrical current to corona electrodes of an electrostatic device.

FIG. 2 is a schematic diagram of the an electrostatic device 201, such as an electrostatic fluid accelerator described in one or more of the previously cited patent applications or similar devices that include one or more corona discharge electrodes, or more simply "Corona Electrodes" 202. A High Voltage Power Supply (HVPS) 207 is connected to each of the Corona Electrodes 202 so as to create a corona discharge in the vicinity of the electrodes. Typically, HVPS 207 supplies several hundreds or thousands of volts to Corona Electrodes 202. Heating Power Supply (HPS) 208 supplies a relatively low voltage (e.g., 5–25 V), constant power output (e.g., 1.5 or 1.6 W/inch) for resistive heating of Corona Electrodes 202. The arrangement of Corona Electrodes 202 may include any appropriate number of the corona electrodes, although nine are shown for ease of illustration. All of the corona electrodes are connected to the output terminals of HVPS 107. Other terminals of HVPS 207 (not shown) may be connected to any other electrodes, e.g., collector electrodes. First terminal ends of Corona Electrodes 202 are connected together by Bus 203, the other end of each being connected to a respective one of Switches 209 through which power from HPS 208 is supplied. That is, all Switches 209 are connected to one terminal of the HPS 208. Another terminal of the HPS 208 is connected to the common point of the Corona Electrodes 202, e.g., Bus 203 as shown. Although generally depicted as conventional mechanical switches, any appropriate switching or current controlling device or mechanism may be employed for Switches 209, e.g., SCR's, transistors, etc.

One of the modes of operation is described as follows. Initially, all switches 209 are open (HPS 208 not connected). In this normal operational mode, HVPS 207 generates a high voltage at a level sufficient for the proper operation of Corona Electrodes 202 to generate a corona discharge and thereby accelerate a fluid in a desired fluid flow direction. Control circuitry 210 periodically disables HVPS 207, activates and connects HPS 208 to one or more corona electrodes via wires 205 and 206 and switches 209. If, for instance, one corona electrode is connected at a time, then only one switch 209 is ON, while the remaining switches are OFF. The appropriate one of Switches 209 remains in the ON position for a sufficient time to convert metal oxide back to the original metal. This time may be experimentally determined for particular electrode materials, geometries, configurations, etc. and include attainment of some temperature required to effect restoration of the electrode to near original condition as existing prior to formation of any oxide layers. After some predetermined event, (e.g., lapse of some time period, drop in electrode resistance, electrode temperature, etc.) which will indicate completion of the heating cycle for a particular electrode or set of commonly heated electrodes, the corresponding switch is turned OFF and another one of Switches 209 is activated to its ON position. If a constant current of constant power source is used to supply the heating current, it may be desirable to include a slight overlap between the ON conditions of sequentially heated stages, e.g., provide a "make-before-break" switching arrangement to avoid an open circuit condition wherein the power supply is not connected to an appropriate load for some finite switching period. Switches 209 may be operated to turn ON and OFF in any order until all of the corona electrodes are heated. Alternatively, some sequence of operations may be employed to optimize either the cleaning operation and/or corona discharge operations. Upon completion of the heating cycle of the last of the electrodes, the control circuitry turns the last switch 209 OFF and enables HVPS 207 to resume normal operation in support of corona discharge functioning.

While the operation has been explained in terms of completing a cleaning cycle for all electrodes prior to resumption of normal device operations, other protocols may be employed. For example, normal device operation may be resumed after heat cycling of less than all electrodes so that normal device operations are interrupted for shorter, though more frequent, cleaning operations. This may have the benefit of minimizing local heating problems if all electrodes were cleaned in sequence. According to an embodiment of the invention wherein heat cycling is responsive to some criteria other than strictly time (e.g., detection of a high electrode resistance), it would be expected that it would be unlikely that all electrodes would simultaneously exhibit such criteria as might initiate a cleaning cycle. Thus, it is possible that cleaning would be accomplished as needed with shorter interruptions of normal device operation.

Further, it may be possible to interrupt operation of only those electrode currently being cleaned while allowing continued operation of other electrodes. It is further possible that appropriate circuitry may be provided and employed to allow application of a heating current (or otherwise apply power) to produce thermal energy while simultaneously and continuously applying power from HVPS 207 for normal corona discharge operation of those electrodes. Further, if heating of the air is desired, e.g., as part of an HVAC (heating, ventilation, and air-conditioning) function, the cleaning process may be integrated into the normal electric heating function.

Corona electrodes 202 may be of various compositions, configurations and geometries. For example, the electrodes may be in the form of a thin wire made of a single material, such as silver, or of a central core material of one substance (e.g., a high temperature metal such as tungsten) coated with an outer layer of, for example, an ozone reducing metal such as silver (further explained below in connection with FIGS. 8 and 9). In a composite structure, the core and outer layer materials may be selected to provide the appropriate overall electrical resistance and resistive heating of the electrodes without requiring an excessive current. Thermal expansion may also be considered to avoid distortion of the electrode during heating and to minimize stress and fatigue induced failure caused by repeated heating and cooling of the wires during each cleaning cycle.

Figure 5:
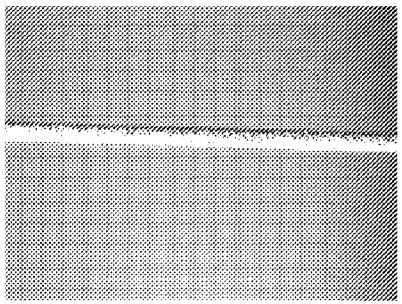
FIG. 5 is a photograph of the corona electrode depicted in FIG. 2 after heat treatment according to an embodiment of the invention resulting in a chemical reduction conversion of the oxide layer to a non-oxidized silver.
Figure 4:
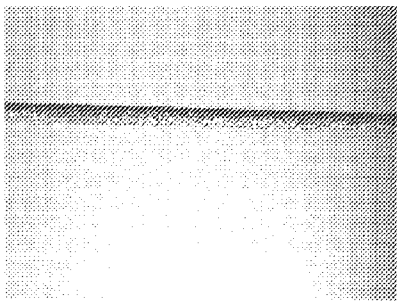
FIG. 4 is a photograph of a corona electrode after being in operation resulting in formation of a dark oxide layer.
Figure 3:
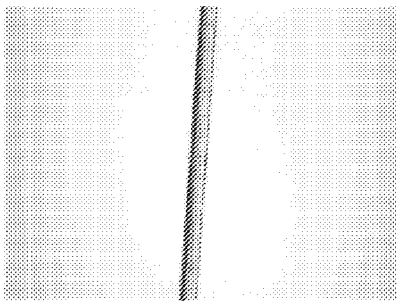
FIG. 3 is a photograph of a new corona electrode prior to use.

Actual test results are presented in FIGS. 3–5. In particular, FIG. 3 depicts a new corona electrode comprising of a silver plated wire having an outer silver metallic coating over a stainless steel core. It can be seen that the wire has a shiny, even surface devoid of an oxidation or other visible contaminants.

FIG. 4 is a photograph of the wire pictured in FIG. 3 after being placed in the active corona discharge for 72 hours. The surface of the wire can be seen to be significantly darker in color due to the oxidation of the silver coating. It can be expected that, if the wire is operated to create a corona discharge for a sufficiently long period of time, all of the silver will be converted into silver oxide. This will eventually adversely effect electrode operation and may ultimately result in degradation and/or damage to (and failure of) the electrode core material and the electrode as a whole.

FIG. 5 is a photograph of the same wire after being heated with an appropriate electrical current. It can be observed that the surface of the wire is again shiny due to conversion of the silver oxide layer back to molecular silver by the removal of oxygen. This reconverted layer completely covers the wire. Electrical measurement demonstrates that the silver coating is substantially restored to its original unoxidized state.

Figure 6:
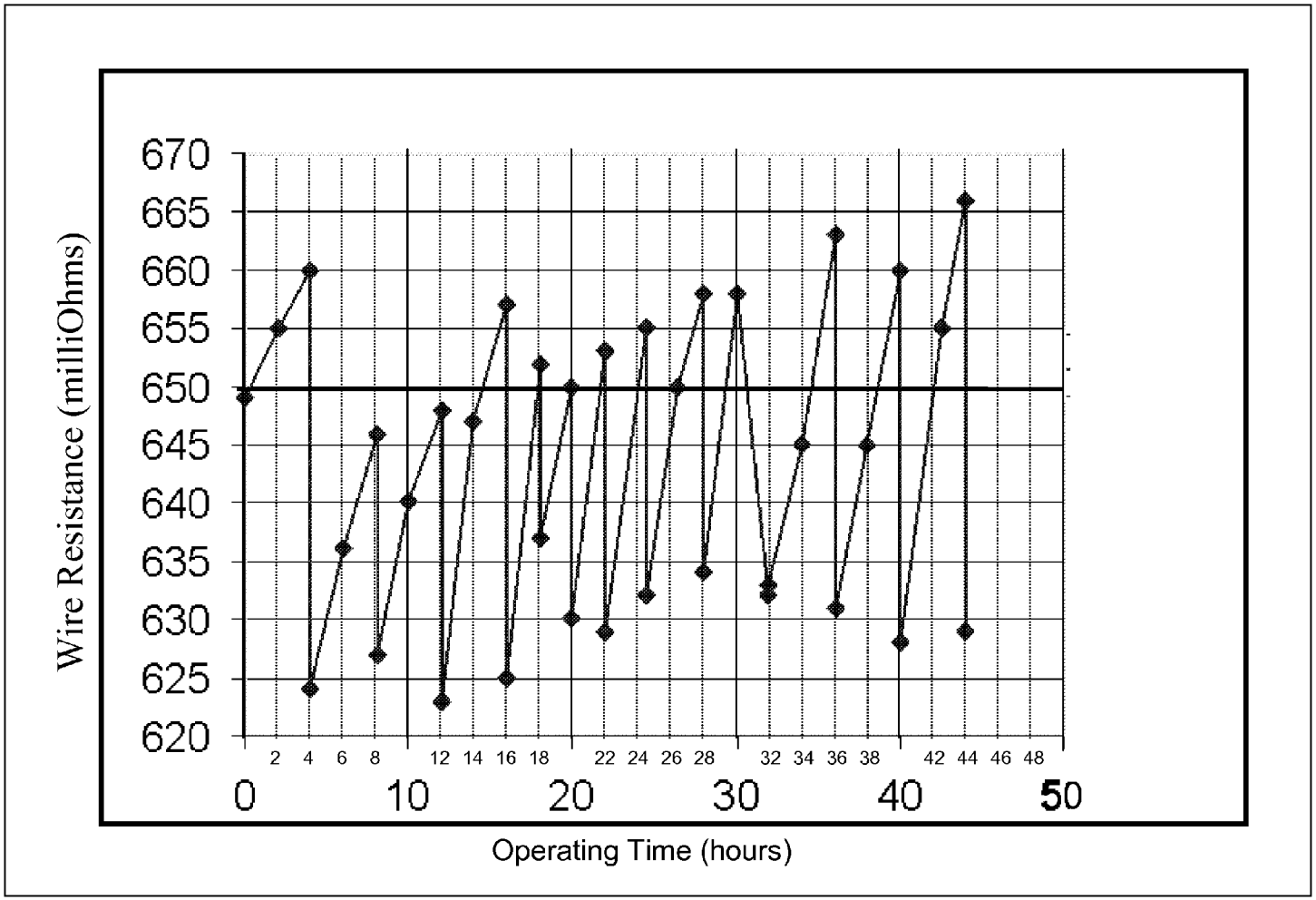
FIG. 6 is a graph depicting wire resistance versus time during repeated cycles of oxidation/deoxidation processing.

FIG. 6 is a graph depicting the resistance of a corona electrode (wire) resistance versus time. As shown therein, corona wire resistance increases from approximately 648 milli-Ohms to 660 mill-Ohms during first two hours of operation (an operating/heating cycle having an average period length of approximately 3⅓ hours is shown as an example) and at the end of each such cycle is heated for 30 seconds to the temperature that is in a range 200–300° C. As a result of an initial heating cycle, corona wire resistance is significantly reduced to a level below the starting resistance of 648 milli-Ohms, dropping to approximately 624 milli-Ohms. Thus, this embodiment of the invention provides an even lower resistance than exhibited by and characteristic of a new, untreated electrode wire. Subsequent operating/heating cycles result in restoration of electrode resistance to approximately equal or just slightly greater than that at the start of each operating cycle (e.g., elimination of 80 percent and often 90 to 95 percent or more of a resistance increase experienced during each operating cycle). This operating/heating cycle is repeated with only a gradual increase of electrical resistance over time with respect to the electrical resistance observed upon the completion of each electrode cleaning or electrode restoration cycle.

Figure 7:
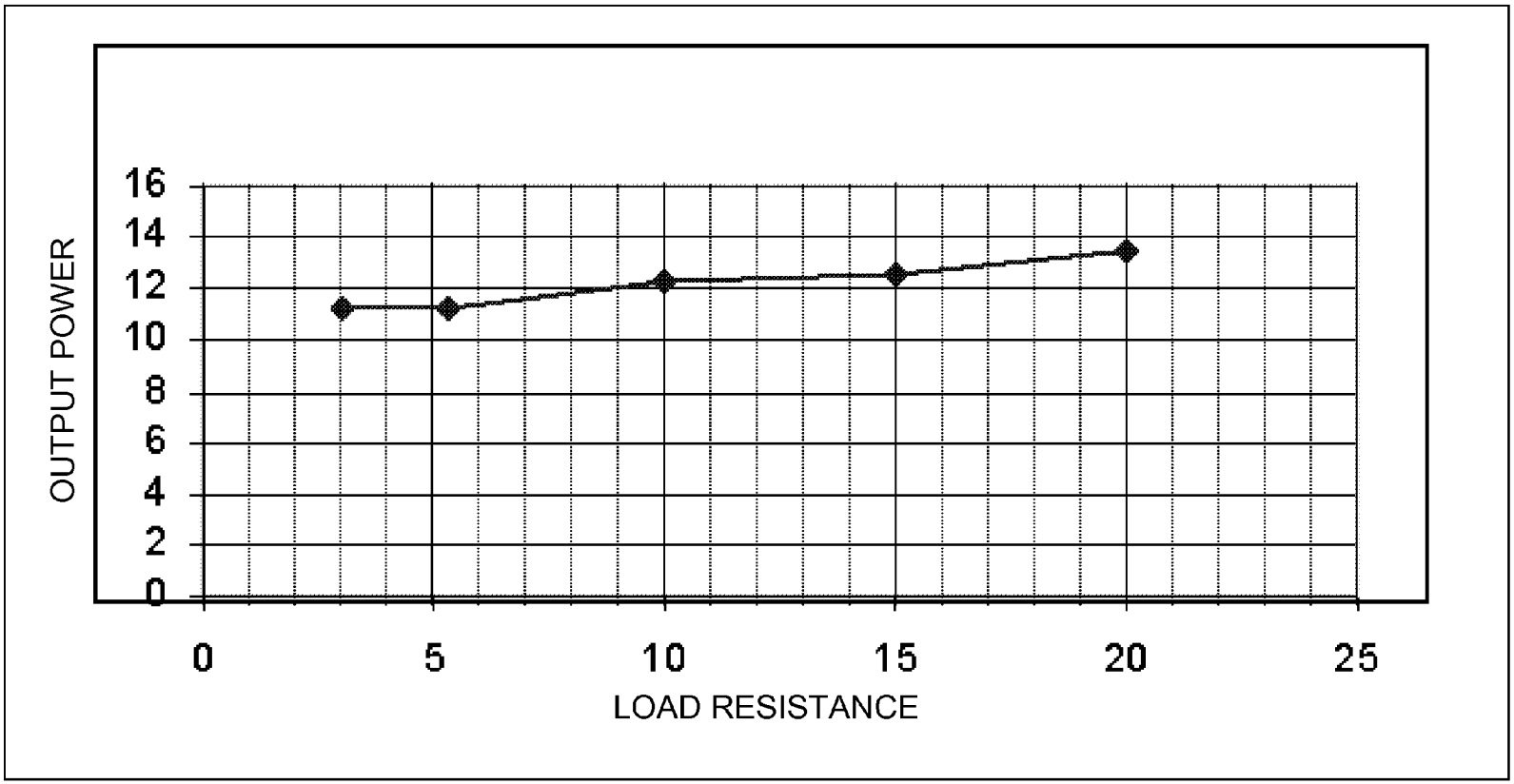
FIG. 7 is a voltage versus current diagram of real flyback converter operated in a discontinuous mode.

FIG. 7 shows a graph depicting output power versus load resistance for a typical fly-back converter. While load resistance is well out of the range of the expected resistance variation, output power remains within a range necessary to ensure adequate electrode heating and results in an increase of electrode temperature to that required to effect material restoration (deoxidation). See, for example, U.S. Pat. No. 6,373,726 of Russell, U.S. Pat. No. 6,023,155 of Kalinsky et al., and U.S. Pat. No. 5,854,742 of Faulk for further details of fly-back converters.

Figure 8:
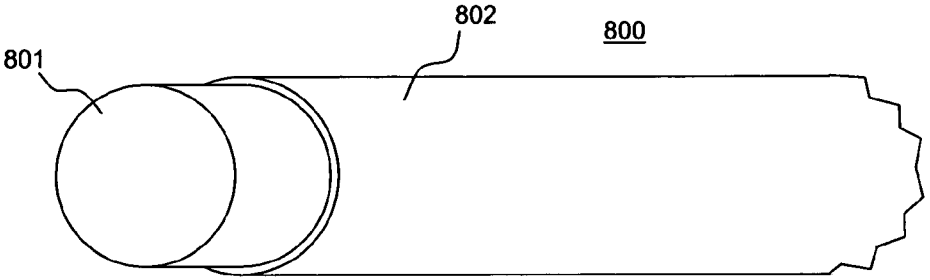
FIG. 8 is a perspective view of a corona electrode including a solid core material with an outer layer of silver.

FIG. 8 is a cross-sectional, perspective view of an electrode 800 according to an embodiment of the invention. A substantially cylindrical wire includes a solid inner core 801 and an outer layer 802. Inner core 801 is preferably made of a metal that can tolerate multiple heating cycles without physical or electrical degradation (e.g., becoming brittle), exhibits a coefficient of thermal expansion compatible with the material constituting outer layer 802, and will adhere to outer layer 802. Inner core 801 may also comprise a relatively high resistance material to support resistive heating of the wire and the overlying outer layer 802. Materials suitable for inner core 801 include stainless steel, tungsten, or, more preferably, an alloy such as Inconel® (NiCrFe: Ni 76%; Cr 17%; Fe 7%; $\rho$=103 $\mu\Omega$-cm). Other core materials may include nickel, kovar, dumet, copper-nickel alloys, nickel-iron alloys, nickel-chromium alloys, beryllium copper, phosphor bronze, brass, molybdenum, manganin. According to a preferred embodiment of the invention, outer layer 802 is plated silver, although other metals such as lead, zinc, cadmium, and alloys thereof may be used as previously explained. While electrode 800 is shown having a substantially cylindrical geometry, other geometries may be used, including those having smooth outer surfaces (e.g., conic sections), polygonal cross-sections (e.g., rectangular solids) and irregular surfaces.

Figure 9:
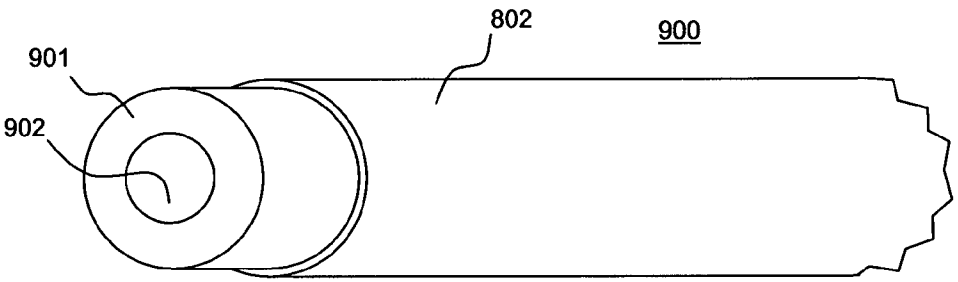
FIG. 9 is a perspective view of a corona electrode including a hollow core material with an outer layer of silver.

According to another embodiment shown in FIG. 9, an electrode 900 includes a hollow core including a tubular portion 901 having a central, axial void 902. Tubular portion 901 is otherwise similar to inner core 801. Outer layer 802 of, e.g., silver, overlies tubular portion 901.

In this disclosure there is shown and described only the preferred embodiments of the invention and but a few examples of its versatility. It is to be understood that the invention is capable of use in various other combinations and environments and is capable of changes or modifications within the scope of the inventive concept as expressed herein. For example, while direct application of an electric current has been described according to one embodiment of the invention as a means for accomplishing electrode heating, other means of heating may be used including, for example, other forms of coupling may be used to induce a current in an electrode structure (e.g., electromagnetically induced eddy current heating, radiant heating of electrodes, microwave heating, placing the electrode under high temperature etc.) Furthermore, it should be noted and understood that all publications, patents and patent applications mentioned in this specification are indicative of the level of skill in the art to which the invention pertains. All publications, patents and patent applications are herein incorporated by reference to the same extent as if each individual publication, patent or patent application was specifically and individually indicated to be incorporated by reference in its entirety.

What is claimed is:

1. A method of operating a corona discharge device comprising the steps of:

producing a high-intensity electric field in an immediate vicinity of a corona electrode and heating at least a portion of the corona electrode to a temperature sufficient to mitigate an undesirable effect of an impurity formed on said corona electrode, wherein said steps of producing a high intensity electric field and heating do not overlap.

2. The method according to claim 1 wherein said portion of said corona electrode comprises a metal readily oxidized in a strong electric field in the presence of oxygen and selected from the group consisting of silver, lead, zinc and cadmium.

3. The method according to claim 1 wherein said portion of said corona electrode is heated to attain a temperature T sufficient for deoxidation of a material forming said corona electrode.

4. The method according to claim 1 wherein said step of producing a high intensity electric field includes applying a high voltage to said corona electrode sufficient to cause a corona discharge from said corona electrode and said step of heating includes applying a low voltage to said corona electrode, wherein said steps of applying said high voltage and said low voltage do not overlap.

5. The method according to claim 1 wherein said step of heating is performed periodically so as to reduce oxidation products of a material of said corona electrode formed during preceding steps of producing said high-intensity electric field.

6. The method according to claim 1 wherein said portion of said corona electrode comprises a material that readily oxidizes in an oxygen atmosphere under the influence of said high intensity electric field.

7. The method according to claim 1 wherein said step of heating includes a step of monitoring an electrical resistivity characteristic of said corona electrode and, in response, heating said portion of said corona electrode.

8. The method according to claim 1 wherein said impurity comprises an oxidized surface layer of a material forming said corona electrode.

9. The method according to claim 8 wherein said step of producing a high intensity electric field includes applying a high voltage to said corona electrode sufficient to cause a corona discharge from said corona electrode and said step of heating includes apply a low voltage to said corona electrode, wherein said steps of applying said high voltage and said low voltage do not overlap.

10. The method according to claim 1 wherein said step of heating includes a step of terminating an application of a heating voltage to said corona electrode in response to detecting a predetermined electrical characteristic said corona electrode.

11. The method according to claim 10 wherein said electrical characteristic includes a characteristic selected from the group consisting of resistivity, conductivity, resonant frequency, and electromagnetic susceptibility.

12. The method claim 1 wherein said step of heating is performed periodically and includes a step of measuring a period of time since a last heating cycle and, in response to a lapse of a predetermined time period, heating said portion of said corona electrode by flowing an electrical current therethrough.

13. The method according to claim 1 wherein said step of heating is performed periodically and includes a step of measuring a time period of a current heating cycle and, in response to expiration of a predetermined period of time, terminating the current heating cycle by interrupting an electrical current flowing therethrough.

14. The method according to claim 1 including the steps of terminating said step of producing prior to initiating said step of periodically heating and, upon completion of said step of periodically heating, reinitiating said step of producing said high-intensity electric field.

15. The method according to claim 1 wherein said heating step includes a step of applying an electric current to said corona electrode to cause said corona electrode to attain said temperature sufficient to mitigate said undesirable effect.

16. The method according to claim 1 wherein said step of producing said high intensity electric field includes producing said high intensity electric field in an immediate vicinity of an ionizing edge of said corona electrode.

17. The method according to claim 1 wherein said step of producing said high intensity electric field includes producing said high intensity electric field in an immediate vicinity of respective ionizing edges of each of a plurality of corona electrodes so as to generate an ionic wind and said step of heating includes heating at least a portion of each of said plurality of corona electrodes to mitigate formation of an oxide thereon.

18. A method of operating a corona discharge device comprising the steps of:

applying a high voltage to a plurality of corona electrodes for producing a high-intensity electric field in an immediate vicinity of each of said plurality of corona electrodes;

detecting an electrical characteristic of said corona electrodes indicative of an oxidation of said corona electrodes;

interrupting application of said high voltage to at least a first group of said corona electrodes so as to terminate said step of producing said high-intensity electric field with regard to said first group of corona electrodes;

applying a heating current to said first group of corona electrodes sufficient to raise a temperature thereof resulting in at least partial elimination of an oxide formed on said first group of corona electrodes; and reapplying said high voltage to said first group of corona electrodes so as to resume production of said high-intensity electric field.

19. The method according to claim 18 wherein said plurality of corona electrodes are divided into a plurality of groups including said first group and said step of applying said heating current is sequentially repeated with respect to each of said groups.

20. The method according to claim 19 wherein said repeated application of said heating current to each of said groups of corona electrodes is completed for all of said plurality of corona electrodes prior to said step of reapplying said high voltage to any of said corona electrodes.

21. The method according to claim 19 wherein said plurality of corona electrodes are divided into a plurality of said groups including said first group of corona electrodes and said steps of interrupting application of a high voltage, applying said heating current, and reapplying said high voltage are performed serially for each of said groups of corona electrodes so that said high voltage is interrupted, and said heating current is applied, to a single group of said corona electrodes at any one time, the other groups continuing to have said high-voltage applied thereto.

22. The method according to claim 18 wherein said step of producing a high-intensity electric field in an immediate vicinity of a plurality of corona electrodes includes producing said high intensity electric field in an immediate vicinity of ionizing edges of said corona electrodes so as to generate an ionic wind.

23. A corona discharge device comprising:

a high voltage power supply connected to corona electrodes generating a high intensity electric field in an immediate vicinity of said corona electrodes;

a low voltage power supply connected to said corona electrodes for resistively heating said corona electrodes; and control circuitry for alternatively applying said high voltage power supply and low voltage power supply to said corona electrodes.

24. The corona discharge device according to claim 23 wherein said corona electrodes include a surface material of a metal readily oxidized in an oxygen atmosphere in the presence of a said high intensity electric field and selected from the group consisting of silver, lead, zinc and cadmium.

25. The corona discharge device according to claim 23 wherein said low voltage power supply is configured to heat said corona electrodes to attain a temperature T sufficient for deoxidation of said corona electrodes and given by the equation $$T>\Delta H^{\circ}_{rxn}/\Delta S^{\circ}_{rxn}$$

where $\Delta H^{\circ}_{rxn}$ is the standard state enthalpy (Dhorxn) and $\Delta S^{\circ}_{rxn}$ is the standard state entropy changes for the oxidation process of a surface material of said corona electrode.

26. A corona discharge device according to claim 23 further including a timer, said control circuitry responsive to said timer for periodically interrupting application of said high voltage power to said corona electrodes, applying said low voltage to said corona electrodes and, subsequently, resuming application of said high voltage power supply to said corona electrodes.

27. The corona discharge device according to claim 23 wherein said control circuitry comprises a switch.

28. The corona discharge device according to claim 23 further comprising measurement circuitry configured to detect an electrical characteristic indicative of an oxidation of said corona electrodes, said control circuitry responsive to said electrical characteristic for applying said low voltage to said corona electrodes.

29. The corona discharge device according to claim 28 wherein said measurement circuitry indicates an electrical resistance of said corona electrodes.

30. The corona discharge device according to claim 23 wherein said low voltage power supply is configured to supply a controlled magnitude of electric power dissipation in said corona electrodes.

31. The corona discharge device according to claim 23 wherein said low voltage power supply is configured to periodically accumulate and discharge a controlled amount of electromagnetic energy to said corona electrodes.

32. The corona discharge device according to claim 23 wherein said low voltage power supply comprises a fly-back power converter.

33. A method of generating a corona discharge comprising the steps of:

generating a high intensity electric field in a vicinity of a corona electrode;

converting a portion of an initial corona electrode material of said corona electrode using a chemical reaction that decreases generation of a corona discharge by-product;

interrupting said step of generating said high intensity electric field in said vicinity of said corona electrode; and heating the corona electrode to a temperature sufficient to substantially restore the converted part of the corona electrode material back to the initial corona electrode material.

34. The method according to claim 33 wherein said corona discharge by-product comprises ozone.

35. A method of operating a corona discharge device comprising the steps of:

producing a high-intensity electric field in an immediate vicinity of a plurality of corona electrodes to thereby generate an ionic wind;

temporarily suspending said production of said high-intensity electric field to suspend said generation of said ionic wind;

heating the corona electrodes to a temperature sufficient to mitigate an undesirable effect of an oxide formed on said corona electrode while said generation of said ionic wind is suspended; and resuming production of said high-intensity electric field in said immediate vicinity of said plurality of corona electrodes to thereby resume said generation of said ionic wind.

* * * * *